US011223917B1

(12) United States Patent
Barone

(10) Patent No.: US 11,223,917 B1
(45) **Date of Patent: *Jan. 11, 2022**

(54) ACOUSTIC EARS METHOD AND DEVICES

(71) Applicant: Frank Barone, Chula Vista, CA (US)

(72) Inventor: Frank Barone, Chula Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/227,373

(22) Filed: Apr. 11, 2021

Related U.S. Application Data

(63) Continuation of application No. 17/094,895, filed on Nov. 11, 2020, now Pat. No. 10,979,830.

(51) Int. Cl.
*H04R 25/00* (2006.01)

(52) U.S. Cl.
CPC ..... *H04R 25/606* (2013.01); *H04R 25/554* (2013.01); *H04R 25/558* (2013.01); *H04R 25/607* (2019.05); *H04R 25/652* (2013.01); *H04R 2225/55* (2013.01)

(58) Field of Classification Search
CPC ..... H04R 1/1016; H04R 1/105; H04R 17/00; H04R 2460/09; H04R 2430/01; H04R 25/02
See application file for complete search history.

(56) References Cited

U.S. PATENT DOCUMENTS 1,708,257 A * 4/1929 Campbell ..... A61F 11/008 181/136
2012/0111659 A1* 5/2012 Vogel ..... A61F 11/008 181/126

* cited by examiner

*Primary Examiner* — Amir H Etesam
(74) *Attorney, Agent, or Firm* — Edmond DeFrank

(57) ABSTRACT

The embodiments disclose a method including fabricating a left acoustic ear and a right side acoustic ear for assisting a user in hearing, molding a concave form configured for a structure of the acoustic ear and mirrored for the left side acoustic ear and right side acoustic ear structures, wherein the concave structure is configured for channeling incoming sounds to the user's ear, molding an ear mounting grip mirrored for coupling to each of the left and right side acoustic ear structures for hooking the acoustic ear to a user's ear, and wherein the ear mounting grip is configured for orienting the concave structure to a front direction corresponding to the user's face.

20 Claims, 8 Drawing Sheets

ACOUSTIC EARS METHOD AND DEVICES

CROSS-REFERENCE TO RELATED APPLICATIONS

This Application is based on U.S. Non-Provisional patent application Ser. No. 17/094,895 filed on Nov. 11, 2020, entitled "ACOUSTIC EARS METHOD AND DEVICES", by Frank Barone.

BACKGROUND

Hearing difficulty can manifest due to medical conditions. In other circumstances difficulty in hearing can be caused due to the increased ambient noise level created by increased vehicular traffic, increased numbers of digital devices playing music and other artificial but real sources of ambient noise. People experiencing difficulty hearing are faced with buying expensive electronic hearing devices and the need for frequently buying replacement batteries.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

General Overview:

It should be noted that the descriptions that follow, for example, in terms of an acoustic ears method and devices is described for illustrative purposes and the underlying system can apply to any number and multiple types hearing conditions. In one embodiment of the present invention, the acoustic ears method and devices can be configured using matching skin tone colors. The acoustic ears method and devices can be configured to include electronic sound devices and can be configured to include digital device interface wireless connectivity using the present invention.

Figure 1:
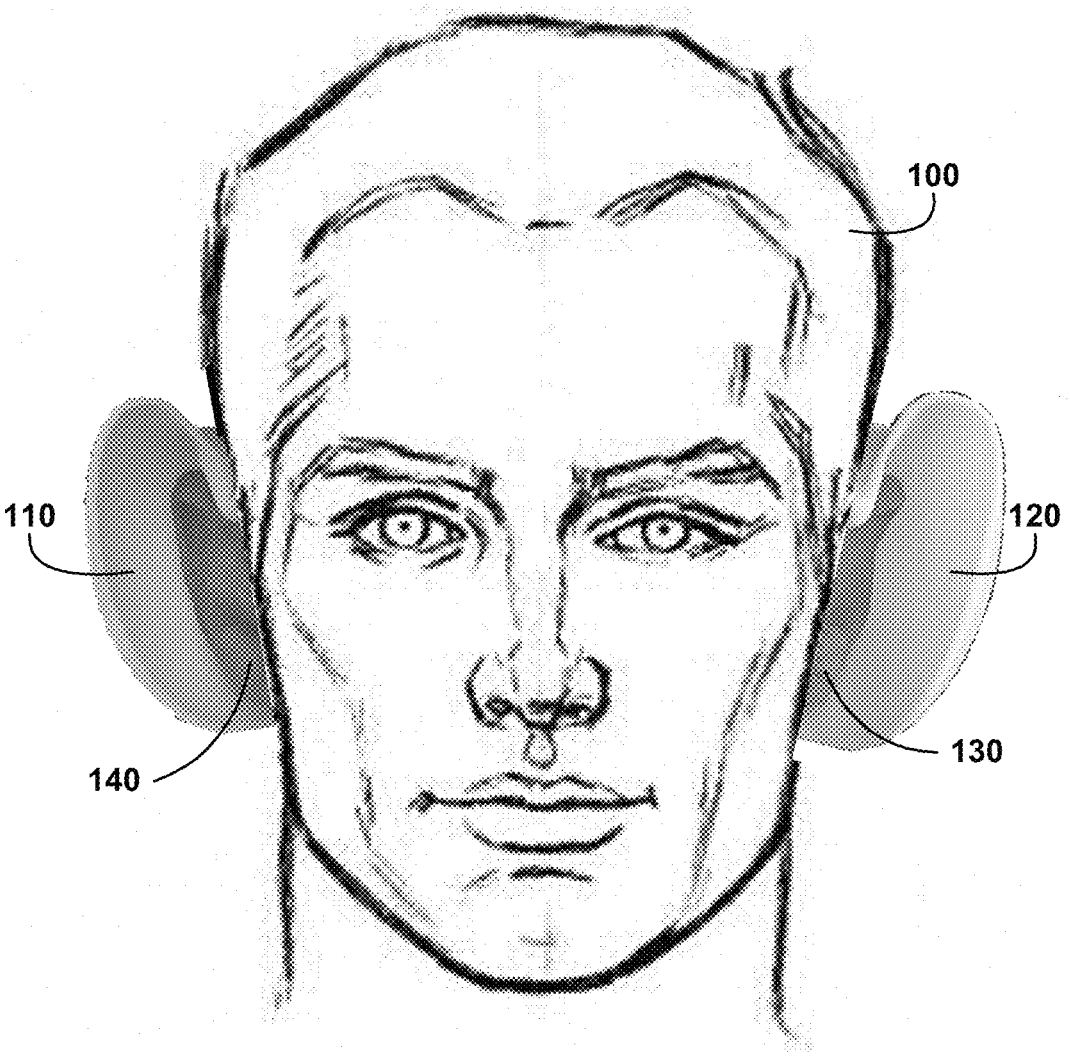
FIG. 1 shows for illustrative purposes only an example of an overview of acoustic ears worn by a user of one embodiment.

FIG. 1 shows for illustrative purposes only an example of an overview of acoustic ears worn by a user of one embodiment. FIG. 1 shows acoustic ears worn by a user. A user 100 hooks a flexible mounting grip integrated into a right side acoustic ear device 110 over a user's right outer ear 140. A user 100 hooks a flexible mounting grip integrated into a left side acoustic ear device 120 over a user's left outer ear 130. The flexible mounting grip conforms to the shape of the rear portion of the ear against the user's head. The flexible mounting grip mounting automatically orients the acoustic ear on each side of the head towards the front of the user of one embodiment.

Figure 2A:
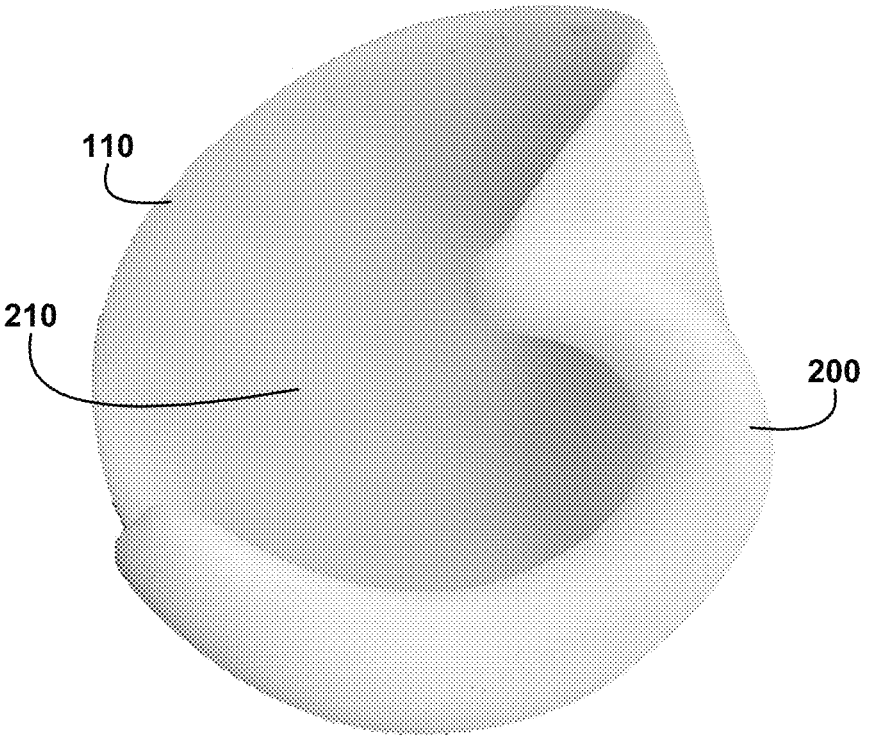
FIG. 2A shows for illustrative purposes only an example of right side acoustic ear interior view of one embodiment.

Detailed Description:

FIG. 2A shows for illustrative purposes only an example of right side acoustic ear interior view of one embodiment. FIG. 2A shows the right side acoustic ear device 110. The right side acoustic ear device 110 includes an acoustic ear right side ear mounting grip 200. The acoustic ear right side ear mounting grip 200 is configured to hook on to the rear exterior portion of a user's right outer ear against the user's head. The positioning of the acoustic ear right side ear mounting grip 200 automatically orients the right side concave interior surface 210 of the right side acoustic ear device 110 towards the front of the user. The forward orientation of the right side concave interior surface 210 receives sound coming from the direction the user is facing for example when talking with another person.

Other examples include facing a movie theater screen, a sporting event, a symphony orchestra playing, a live concert and speakers in an auditorium. The user gains an advantage for example with speakers in an auditorium where the user may be seated in the back of auditorium and may experience hearing clearly what each speaker has to say. The sound receiving area of the concave structure is larger than the user's ears gathers more sound waves and channels those sounds to the user's ear opening. More sound waves of the speaker's voice are directed into the user's ears allowing the user to hear more sound at a louder volume of one embodiment.

Figure 2B:
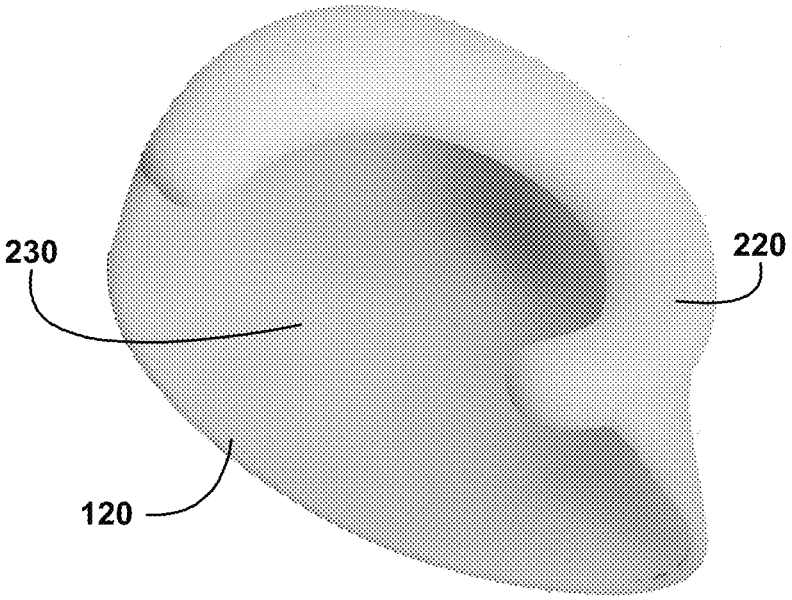
FIG. 2B shows for illustrative purposes only an example of left side acoustic ear interior view of one embodiment.

Left Side Acoustic Ear Interior View:

FIG. 2B shows for illustrative purposes only an example of left side acoustic ear interior view of one embodiment. FIG. 2B shows the left side acoustic ear device 120. The left side acoustic ear device 120 includes an integrated acoustic ear left side ear mounting grip 220. Hooking the acoustic ear left side ear mounting grip 220 on the rear of the user's left outer ear automatically orients the left side concave interior surface 230 towards the front of the user. The left side concave interior surface 230 is oriented to be in the same direction as the user is facing. The left side concave interior surface 230 opening area and surface area are much greater than the user's outer ear. The greater opening and surface area gathers more sound waves and directs the sound waves to the user's left ear opening. More sound waves produce greater volume and clarity of what is being heard by the user of one embodiment.

Figure 3A:
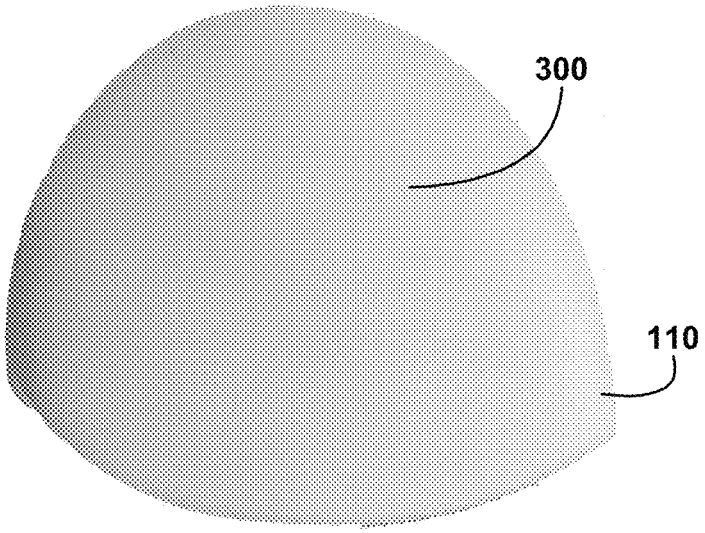
FIG. 3A shows for illustrative purposes only an example of right side acoustic ear exterior view of one embodiment.

Right Side Acoustic Ear Exterior View:

FIG. 3A shows for illustrative purposes only an example of right side acoustic ear exterior view of one embodiment. FIG. 3A shows the right side acoustic ear device 110 and a right side convex exterior surface 300. The right side convex exterior surface 300 provides structural strength to the right side acoustic ear device 110 that maintains the shape of the device of one embodiment.

Figure 3B:
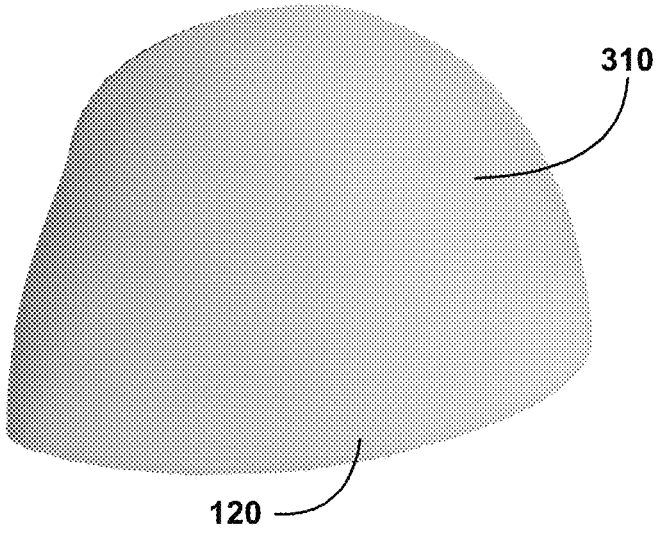
FIG. 3B shows for illustrative purposes only an example of left side acoustic ear exterior view of one embodiment.

Left Side Acoustic Ear Exterior View:

FIG. 3B shows for illustrative purposes only an example of left side acoustic ear exterior view of one embodiment.

FIG. 3B shows the left side acoustic ear device 120 left side convex exterior surface 310. As seen in FIG. 3B the left side convex exterior surface 310 is a smooth surface. In one embodiment the right and left side acoustic ear devices are molded using a firm, flexible and soft rubberized material for example a medical grade silicone and rubber. The rubberized material is light weight and flexible allows a user to wear the acoustic ears for long period of time without discomfort. The flexibility makes it easy and comfortable for hooking and unhooking the devices to and from the ears. The rubberized material firmness characteristic makes the acoustic ear devices durable.

In another embodiment a harder material like acrylic or PVC plastic may be used to create firmness and sound transmitting capabilities for fabricating the acoustic ears.

In yet another embodiment the acoustic ears may be a hybrid fabrication of a firm, flexible and soft rubberized material in contact with the user's skin and a hard material for the sound wave gathering concave receiver. The hybrid mix of materials may include sound dampening materials for example cork, acoustic foam and others to reduce and cancel unwanted noise or high pitch sounds that are not wanted of one embodiment.

Figure 4:
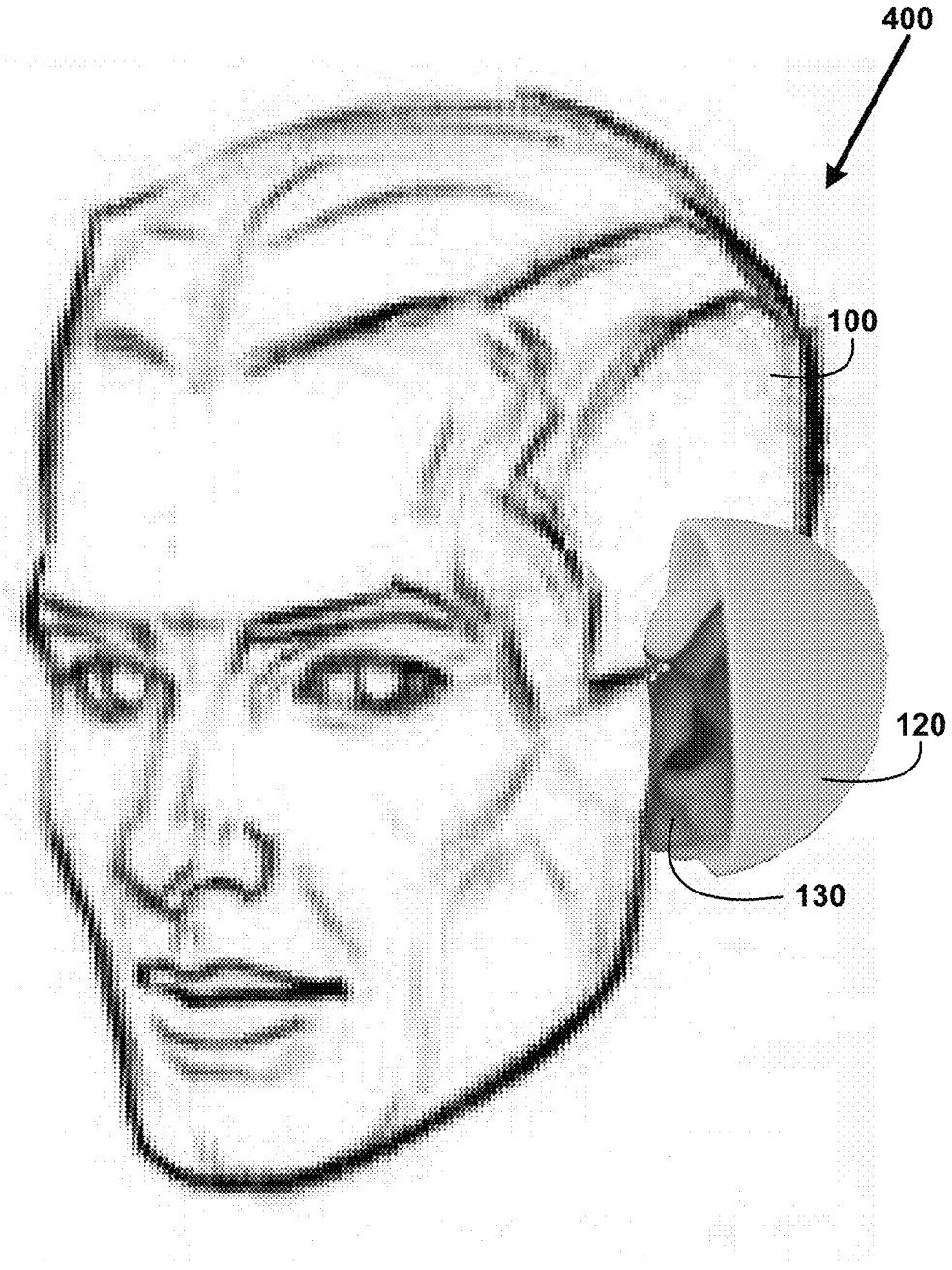
FIG. 4 shows for illustrative purposes only an example of left side view of user wearing the acoustic ear of one embodiment.

Left Side View of User Wearing the Acoustic Ear:

FIG. 4 shows for illustrative purposes only an example of left side view of user wearing the acoustic ear of one embodiment. FIG. 4 shows a user left ear view 400 of the user 100 the left side acoustic ear device 120 hooked over the user left ear 130 of one embodiment.

Figure 5:
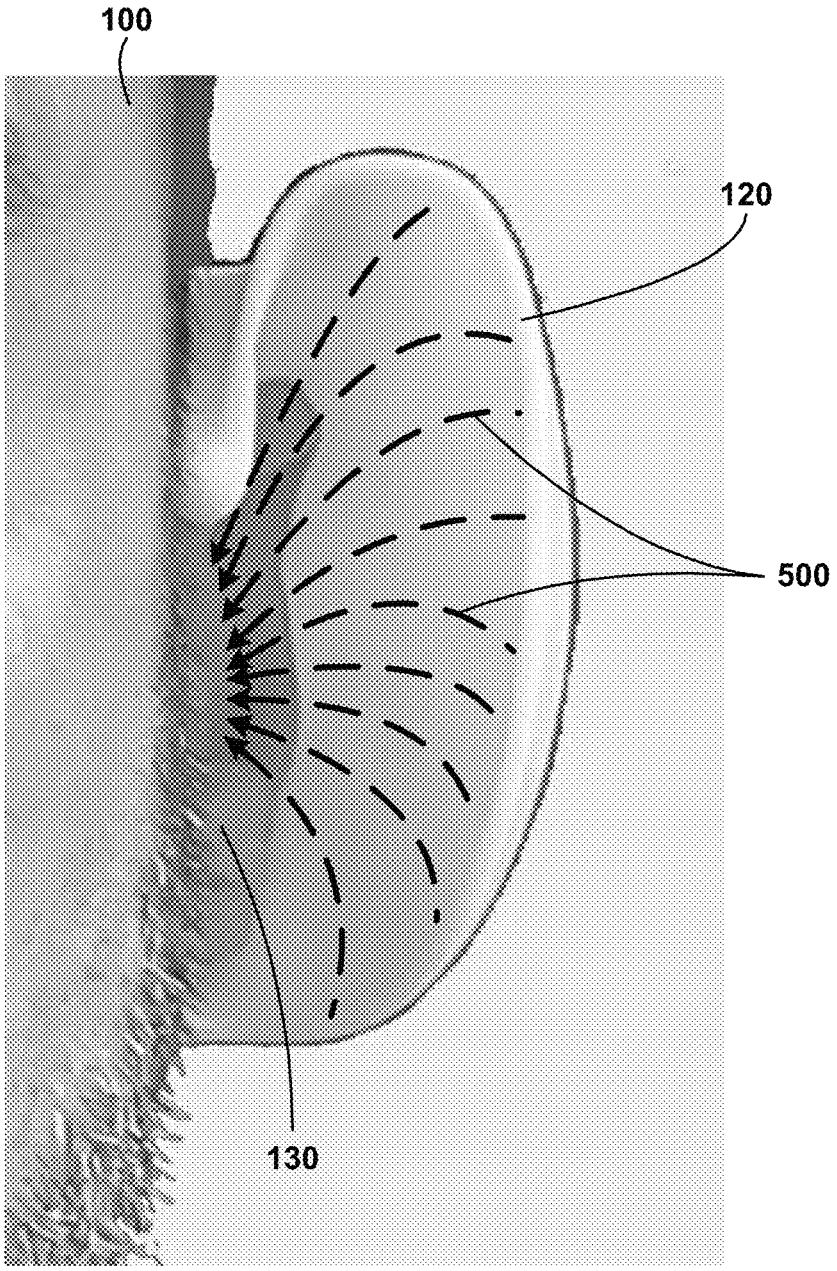
FIG. 5 shows for illustrative purposes only an example of acoustic ear channeling sound to an ear of one embodiment.

Acoustic Ear Channeling Sound to an Ear:

FIG. 5 shows for illustrative purposes only an example of acoustic ear channeling sound to an ear of one embodiment. FIG. 5 shows the user 100 wearing the left side acoustic ear device 120 on the user left ear 130. The curved dashed lines indicate the path of the gathered sound waves entering the left side acoustic ear device 120 and an acoustic ear channeling sound to the user's ear opening 500. This illustration provides some scale indicating the greater the size of the acoustic ear versus the ear opening. Also indicated is the greater area provided by the acoustic ear surface area versus the exterior ear appendage surface area of one embodiment.

Figure 6:
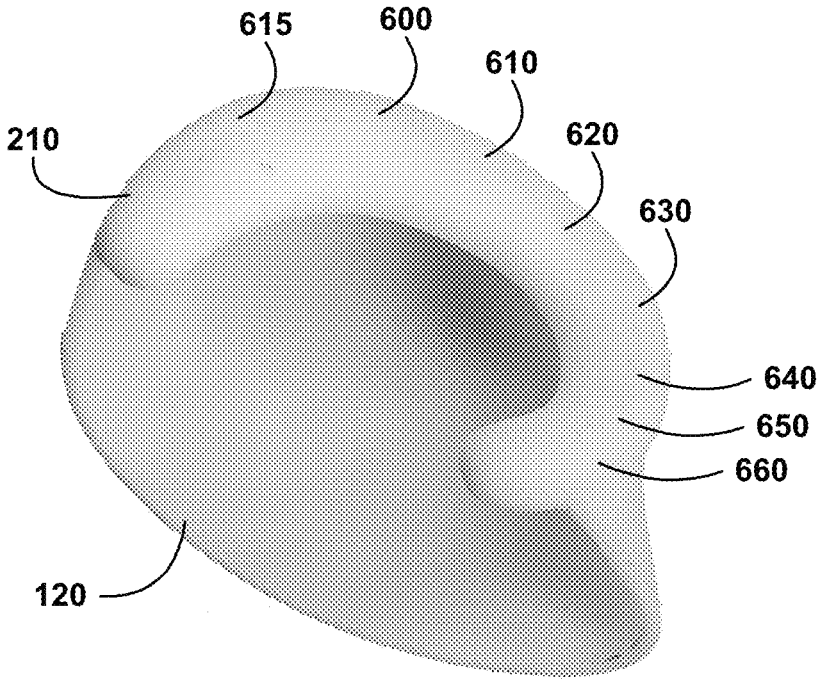
FIG. 6 shows for illustrative purposes only an example of acoustic ear digital modules of one embodiment.

Acoustic Ear Digital Modules:

FIG. 6 shows for illustrative purposes only an example of acoustic ear digital modules of one embodiment. FIG. 6 shows in one embodiment for example the left side acoustic ear device 120. The acoustic ear devices include digital modules to allow the user to have some control over the sounds being gathered by in this example the left side acoustic ear device 120. The digital modules include sensors, detectors and meters for detecting and measuring the conditions surrounding the user and other factors that affect the user's listening to particular sounds of interest to the user. The digital modules including the sensors, detectors, meters and communication devices coupled to the acoustic ear devices and wirelessly coupled to an acoustic ear app 710 of FIG. 7 for detecting and measuring humidity, temperature, wind and air flow, noise levels, GPS locations, Bluetooth communications, taking mobile calls from the user's digital device and receiving and transmitting data from the digital modules with a user's digital device.

A digital decibel meter 600 can be coupled to the left side acoustic ear device 120 for detecting a decibel level of incoming sounds. If the source of an incoming sound is faint a digital amplifier 610 coupled to the left side acoustic ear device 120 will automatically increase the decibel lever to a preset level selected by the user.

Figure 7:
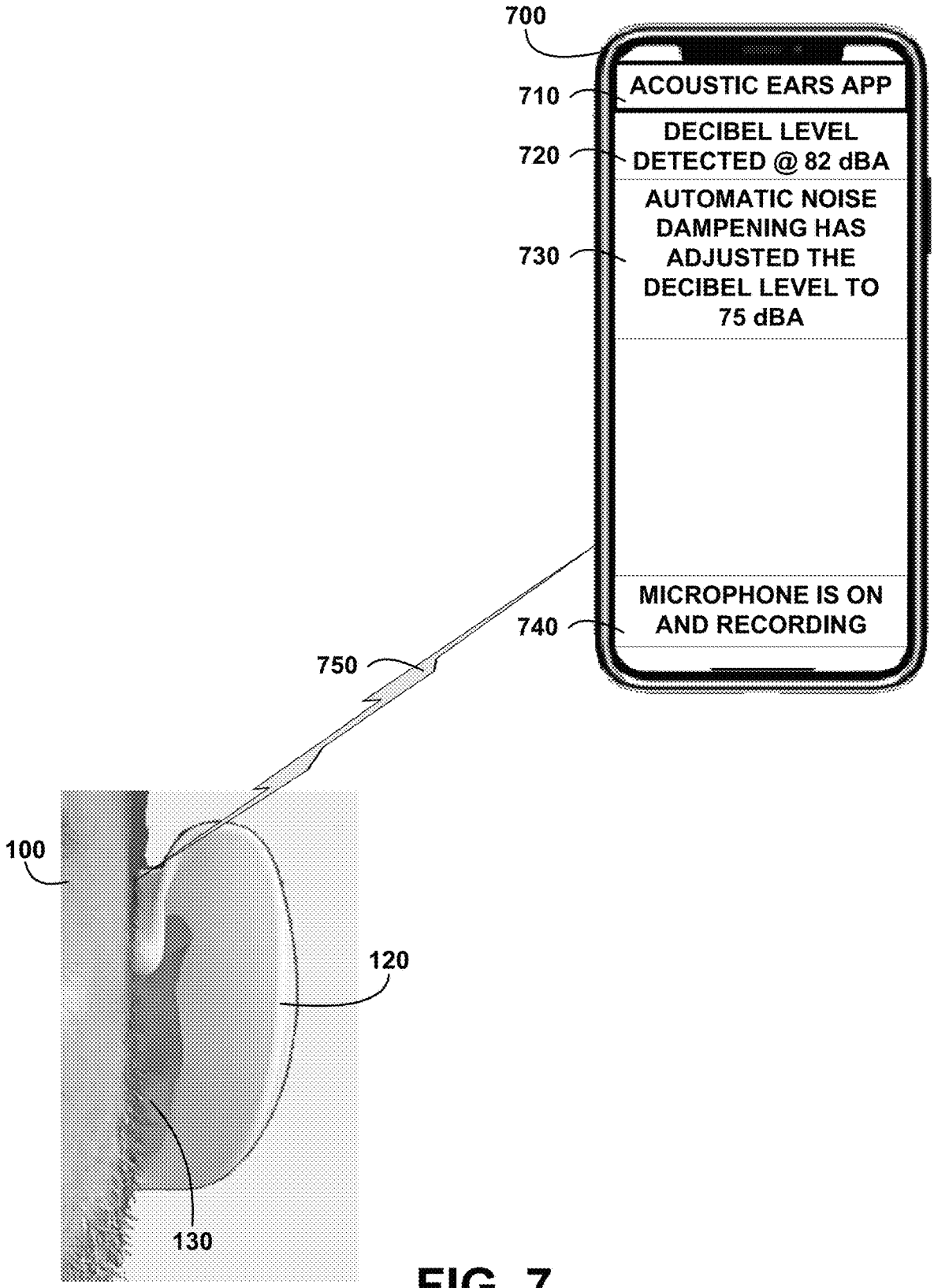
FIG. 7 shows for illustrative purposes only an example of acoustic ear app decibel adjustments of one embodiment.

The digital modules settings are accessed by the user via an acoustic ear app 710 of FIG. 7 installed on a user's digital device for example a mobile phone. The user can preset comfortable sound decibel levels. In one instance the incoming sound can be amplified if too weak and conversely if the incoming sound is too loud a digital sound dampener 620 will automatically reduce the decibel level to the user selected preset comfortable decibel level.

The acoustic ear devices include a Bluetooth 630 device. The Bluetooth 630 device coupled to the acoustic ear device can receive using a near-field transceiver 660 coupled to the acoustic ear device phone calls transmitted to the Bluetooth 630 device from a user's mobile phone with the acoustic ear app 710 of FIG. 7. A digital microphone 650 coupled to the acoustic ear device allows the user to verbally transmit commands to the user digital device via the acoustic ear app 710 of FIG. 7. The acoustic ear app 710 of FIG. 7 in one embodiment includes computer code that will dampen noise sounds for example white, brown and pink noise that at audible frequencies. The digital microphone 650 in one embodiment is configured with coupled noise dampeners to filter out for example the sound of wind and air flowing across the microphone. In another example the microphone is configured to reduce and cancel high pitch sounds that are not wanted. In yet another embodiment the digital microphone 650, digital sound dampener 620 and acoustic ear app 710 of FIG. 7 are configured to include user selectable sounds the user does not want to hear and that could be harmful to the user's hearing. The sound filtering elements of the digital microphone 650, digital sound dampener 620 and acoustic ear app will reduce and cancel the user selected frequencies and pitch of the user unwanted sounds.

The acoustic ear devices include a GPS location detector determined from triangulated cellular signals. Each acoustic ear device transmits periodically as set by the user its GPS location via cellular signal connectivity to the user digital device for example the user's smart phone. The acoustic ear app 710 of FIG. 7 installed on the user's smart phone records the GPS location on a digital memory device. The recorded GPS locations allow the user to track their movements. Tracking GPS locations movements is important during the current pandemic. Additionally the user can track the location of the acoustic ear devices should they be stolen or lost. Further the other digital devices coupled to the acoustic ear devices wirelessly transmit via cellular signals and WIFI connectivity to the acoustic ear app 710 of FIG. 7 the detected and measured data to the acoustic ear app 710 of FIG. 7 and are correlated to the GPS location, date and time. For example the digital decibel meter 600 measured decibel levels as also recorded with the acoustic ear app 710 of FIG. 7 on the memory device of the user's smart phone. In this example the user received an alert alarm transmitted from the acoustic ear app 710 of FIG. 7 to the acoustic ear device coupled Bluetooth 630 device. The alert alarm notified the user that at that GPS location the decibel level exceeded the threshold of harmful sound levels 85 decibels. The user if driving may not have been able to write down the location. The user in reviewing the GPS location of the alert alarm gains knowledge of a location they may desire to avoid to prevent for example hearing loss.

The acoustic ear devices include in one embodiment a digital anemometer to detect wind and air flow speeds. High speed and turbulent wind and air flow can cloak other sounds being captured with the acoustic ear devices. The digital anemometer transmits the speed and turbulence of the wind and air flow to the digital sound dampener 620. The digital sound dampener 620 devices store the decibel level and frequencies of wind and air flow at progressively increasing speeds and turbulence. The digital anemometer data is used to determine the settings of the digital sound dampener 620 to cancel the wind and air flow noise allowing the user to hear for example the conversation, music and other desired listening the user is facing.

The user may not wish to answer a phone call and can verbally instruct the acoustic ear app 710 of FIG. 7 to not answer a phone call and record the caller's message on a digital audio recorder 640 coupled to the acoustic ear device. The user can further instruct the acoustic ear app 710 of FIG. 7 to playback the message when the call disconnects. At least one rechargeable battery 615 is coupled to the acoustic ear device that can wirelessly be recharged on a wireless recharging station of one embodiment.

Acoustic Ear App Decibel Adjustments:

FIG. 7 shows for illustrative purposes only an example of acoustic ear app decibel adjustments of one embodiment. FIG. 7 shows the user 100 wearing the left side acoustic ear device 120 on the user left ear 130. FIG. 7 shows the near-field transceiver receiving data from the acoustic ears app 750 on a user mobile digital device 700.

The right side acoustic ear device 110 and left side acoustic ear device 120 include digital device interface wireless connectivity using an acoustic ear app on a user digital device including a tablet, smart phone, and laptop computer.

Coupling a Bluetooth device to each of the left and right side acoustic ears for providing digital device interface wireless connectivity including WIFI and cellular wireless connectivity between acoustic ears device digital devices and the user's senses of hearing and vision using the acoustic ear app displayed data on a user's digital device.

The acoustic ears app 710 is sending audible voice messages to the user for example "decibel level detected @ 82 dBA" 720. A decibel level of 82 dBA can harm a user's hearing if entering the ears for a period of time. The digital decibel meter 600 of FIG. 6 trigger a signal to the digital sound dampener 620 of FIG. 6 to adjust the incoming sound to the user selected preset decibel level. Upon receiving the digital decibel meter 600 of FIG. 6 signal the digital sound dampener 620 of FIG. 6 automatic noise dampening has adjusted the decibel level to 65 dBA 730. The user is notified with an audible voice message from the acoustic ears app 710. The acoustic ears app 710 displays the audible voice messages in text on the user's mobile digital device 700 including an audible voice message that the microphone is on and recording 740 of one embodiment.

Figure 8:
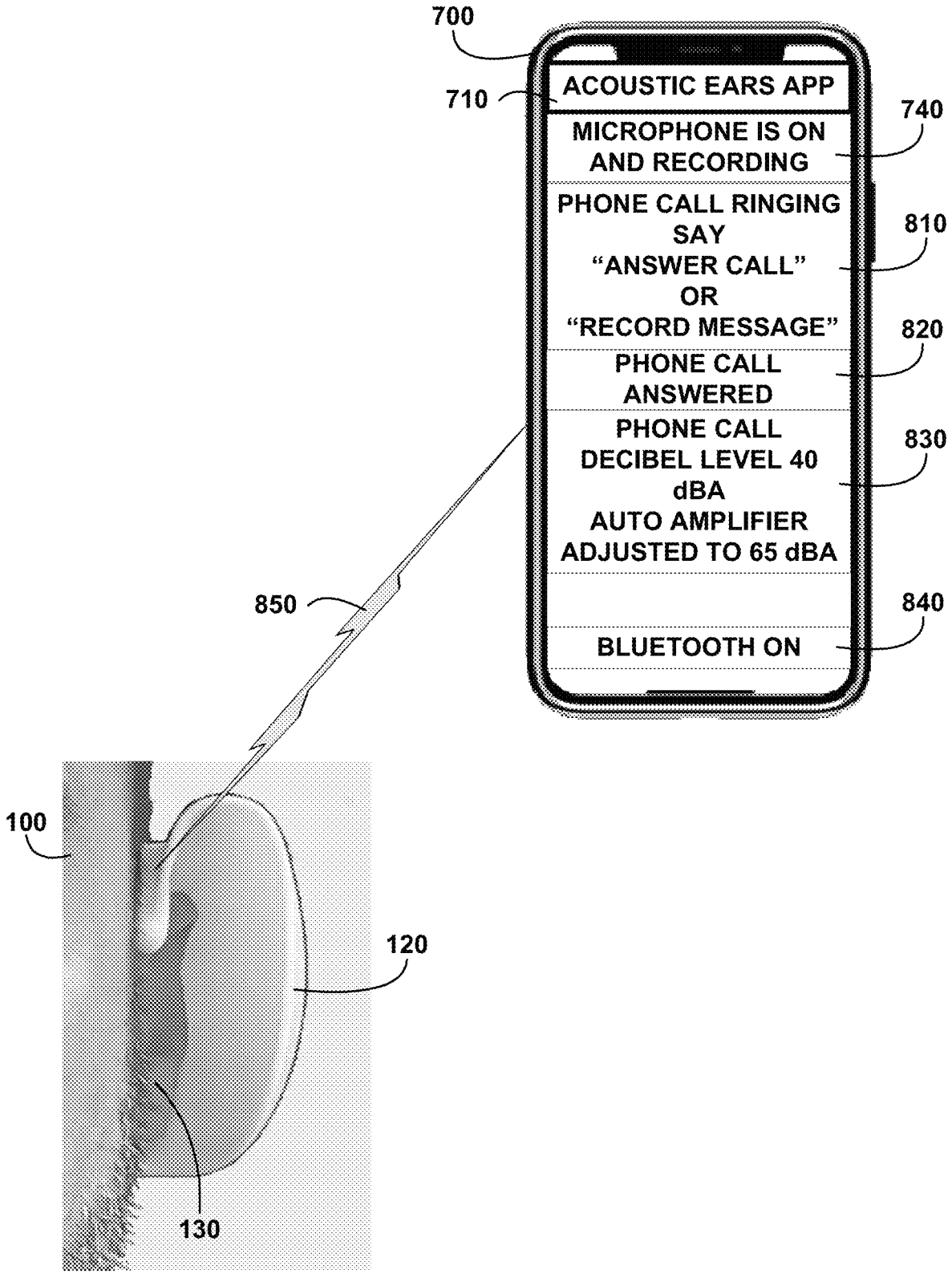
FIG. 8 shows for illustrative purposes only an example of acoustic ear app mobile phone interface of one embodiment.

Acoustic Ear App Mobile Phone Interface:

FIG. 8 shows for illustrative purposes only an example of acoustic ear app mobile phone interface of one embodiment. FIG. 8 shows the user 100, left side acoustic ear device 120 and user left ear 130. The near-field transceiver is transmitting and receiving data to and from the acoustic ears app 750. The user mobile digital device 700 with the acoustic ears app 710 is displaying on the user mobile digital device 700 the microphone is on and recording 740. The acoustic ears app 710 is sending audible voice messages to the user for example phone call ringing say "answer call" or "record message" 810. The user speaks a voice command to "answer call" and "record message". The acoustic ears app 710 sends an audible voice message phone call answered 820. In this example the digital decibel meter 600 of FIG. 6 detects the phone call decibel level and signals the acoustic ears app 710 and the digital amplifier 610 of FIG. 6. The digital amplifier 610 of FIG. 6 makes an automatic decibel level adjustment to user selected preset 65 dBA. The acoustic ears app 710 sends an audible voice message to the user and displays the message "phone call decibel level 40 dBA auto amplification adjusted to 65 dBA" 830. The acoustic ears app 710 sends an audible voice message to the user and displays the message "Bluetooth on" 840. The user speaks the voice command to the acoustic ear app 710 to "playback the message". After listening to the message the user speaks a voice command "call back the phone number". The acoustic ear app 710 digitally dials the phone number and the user hears the call ringing over the Bluetooth 630 module and responds when the other party answers the call of one embodiment.

The foregoing has described the principles, embodiments and modes of operation of the present invention. However, the invention should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. A method, comprising:

providing a left side acoustic ear and a right side acoustic ear for assisting a user in hearing;

providing a concave form configured for a structure of the acoustic ear and mirrored for the left side acoustic ear and right side acoustic ear structures;

wherein the concave structure is configured for channeling incoming sounds to the user's ear; and coupling digital devices to the acoustic ears for regulating sound decibel levels and providing bidirectional wireless communications.

2. The method of claim 1, further comprising coupling electronic sound devices and digital device interface wireless connectivity to the acoustic ear structures.

3. The method of claim 1, further comprising molding materials matching at least one skin tone color for the acoustic ear pair.

4. The method of claim 1, further comprising coupling a digital decibel meter and a digital amplifier to each of the acoustic ears for detecting incoming sound decibel levels.

5. The method of claim 1, further comprising coupling a digital sound dampener to each of the acoustic ears for decreasing high decibel level incoming sounds.

6. The method of claim 1, further comprising coupling a Bluetooth device to each of the acoustic ears for providing digital device interface wireless connectivity.

7. The method of claim 1, further comprising providing digital device interface wireless connectivity using an acoustic ear app on a user digital device.

8. The method of claim 1, further comprising fabricating an acoustic ear using at least one material consisting of a firm, flexible and soft rubberized material, a harder material, and sound dampening materials.

9. The method of claim 1, further comprising providing the acoustic ears with sound filtering elements of a digital microphone, digital sound dampener and an acoustic ear app configured for reducing and cancelling user selected frequencies and pitch of unwanted sounds.

10. The method of claim 1, further comprising providing the acoustic ears with at least one rechargeable battery for powering electronic devices and digital device wireless connectivity devices coupled to the acoustic ears.

11. An apparatus, comprising:

a pair of acoustic ears for assisting a user in hearing;

wherein the pair of acoustic ears are made from a molded elastomer material;

a concave form structure of each acoustic ear configured for channeling sound waves to a user's ear; and an ear mounting grip for hooking an acoustic ear to a user's ear.

12. The apparatus of claim 11, further comprising a concave form structure molded from a hard material for the sound wave gathering coupled to the concave receiver ear mounting grip.

13. The apparatus of claim 11, further comprising a concave form structure molded from at least one sound dampening material including one from a group of cork, acoustic foam and others.

14. The apparatus of claim 11, further comprising the pair of acoustic ears concave forms are made using at least one material consisting of a firm, flexible and soft rubberized material, a harder material, and sound dampening materials.

15. The apparatus of claim 11, further comprising the concave structure is configured with sound dampening materials to reduce and cancel unwanted noise or high pitch sounds that are not wanted.

16. An apparatus, comprising:

an ear mounting grip configured to hook over a user's outer ear;

wherein the ear mounting grip is made a molded elastomer material;

a concave structure coupled to the ear mounting grip and configured for gathering and channeling incoming sounds to the user's ear;

wherein the concave structure sound wave gathering receiver coupled to the ear mounting grip is made from a molded polymer material; and wherein a coupled ear mounting grip and concave structure form an acoustic ear when worn by a user are configured to increase a volume of sound waves directed to the user's ear.

17. The apparatus of claim 16, wherein the concave structure includes sound dampening materials.

18. The apparatus of claim 16, further comprising the concave structures are made with at least one sound dampening material including one from a group of cork, acoustic foam and others.

19. The apparatus of claim 16, wherein the ear mounting grips are configured to orient the concave structures facing front for channeling sound waves to the user's ear.

20. The apparatus of claim 16, further comprising the concave structure includes sound dampening materials to reduce and cancel unwanted noise or high pitch sounds that are not wanted.

* * * * *